United States Patent [19]

Pena-Kipper

[11] 4,022,462

[45] May 10, 1977

[54] APPARATUS FOR PERFORMING PHYSICAL EXERCISES

[76] Inventor: Enrique A. Peña-Kipper, Escobedo Sur 733-201, Monterrey, Mexico

[22] Filed: July 28, 1975

[21] Appl. No.: 599,882

[52] U.S. Cl. ..... 272/74
[51] Int. Cl.[2] ..... A63B 5/22
[58] Field of Search ..... 272/74, 75

[56] References Cited

UNITED STATES PATENTS

| | | | |
|---|---|---|---|
| 169,625 | 11/1875 | Crandall | 272/74 |
| 2,493,224 | 1/1950 | Brunt et al. | 272/74 |
| 3,074,717 | 2/1963 | Lutz | 272/74 |
| 3,493,229 | 2/1970 | Ramsey | 272/74 |
| 3,531,111 | 9/1970 | Shafer | 272/74 |

*Primary Examiner*—Richard C. Pinkham
*Assistant Examiner*—T. Brown
*Attorney, Agent, or Firm*—Laurence R. Brown

[57] ABSTRACT

Exercising apparatus similar to a jump rope is provided in the form of a hand held and hand powered single piece planar rigid frame with offset handlegrips to rotate the frame for continuous jumping exercises by one or several persons. The jump rope is provided with male or female fittings whereby two or more jump ropes may be coupled together for two or more persons to jump side by side.

2 Claims, 7 Drawing Figures

FIG. 1
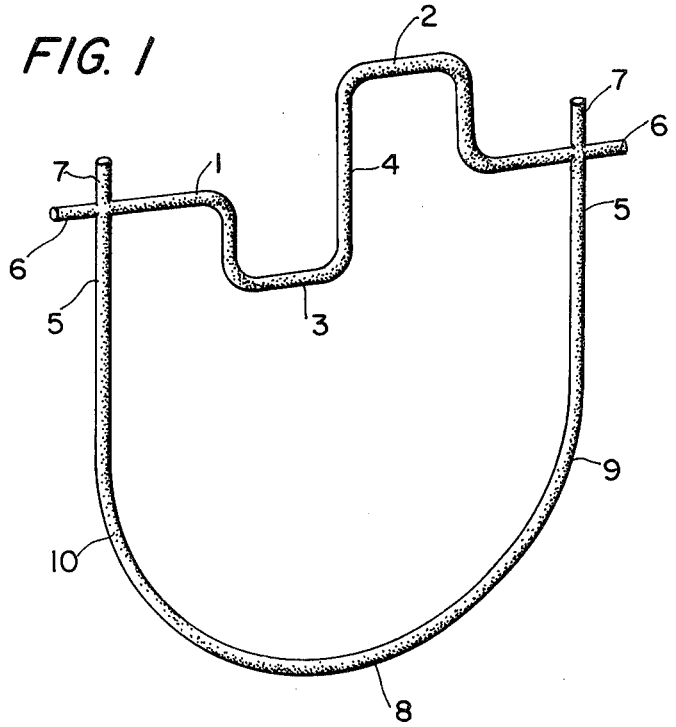
FIG. 2
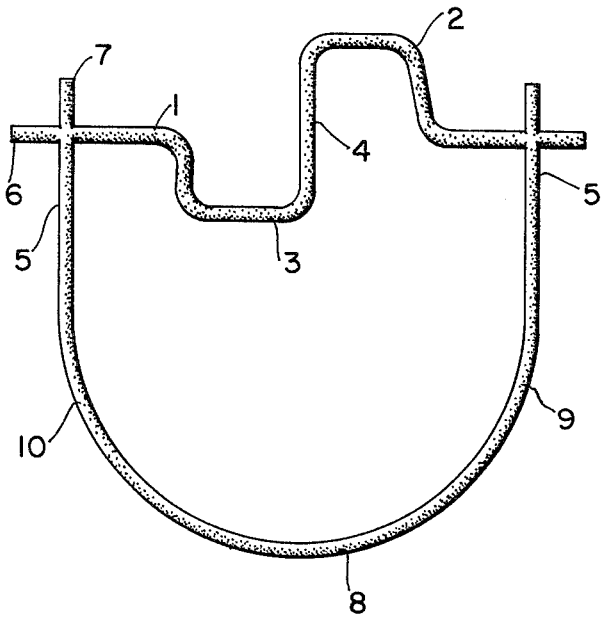
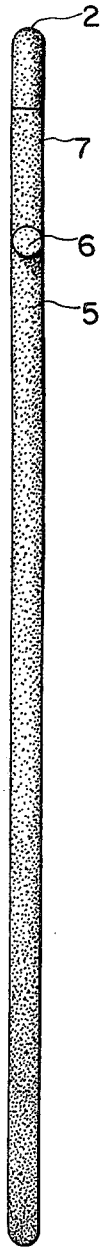
FIG. 3

APPARATUS FOR PERFORMING PHYSICAL EXERCISES

The present invention refers to an apparatus for performing physical exercises, which permits motive power to be provided by the same hands of the person who utilizes the apparatus for jumping within the same by simply operating the handle with which the apparatus is provided. A curved body is joined to the handle forming a single piece with the handle allowing the person who utilizes the apparatus to jump continuously within the same. In addition to this, structure joins this apparatus by its sides to others of similar construction, in such a manner that several persons may jump at the same time, synchronized with the number of apparata installed. Also by adding one or several curved sections, perpendicularly to the handle, they may comprise various sections that force the person utilizing the apparatus to jump continuously.

The purpose of this invention is to provide a practical way for a person to be able to practice a proper physical exercise, very much like the jumping of the rope, which is considerably difficult to perform but conversely is facilitated by means of the invention.

The characteristic details of the present invention are clearly shown in the following description and in the accompanying drawing as illustrated of it and the same reference symbols are used to indicate the same parts in the figures shown:

FIG. 1, shows a perspective view of the apparatus.

FIG. 2, shows an elevated view of the apparatus.

FIG. 3, shows a side view of the apparatus.

Figure 4:
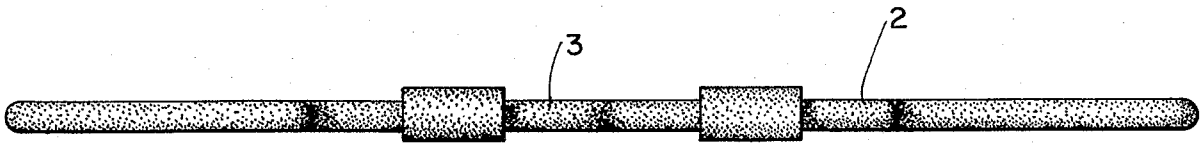
FIG. 4, shows a top view of the apparatus.
Figure 5:
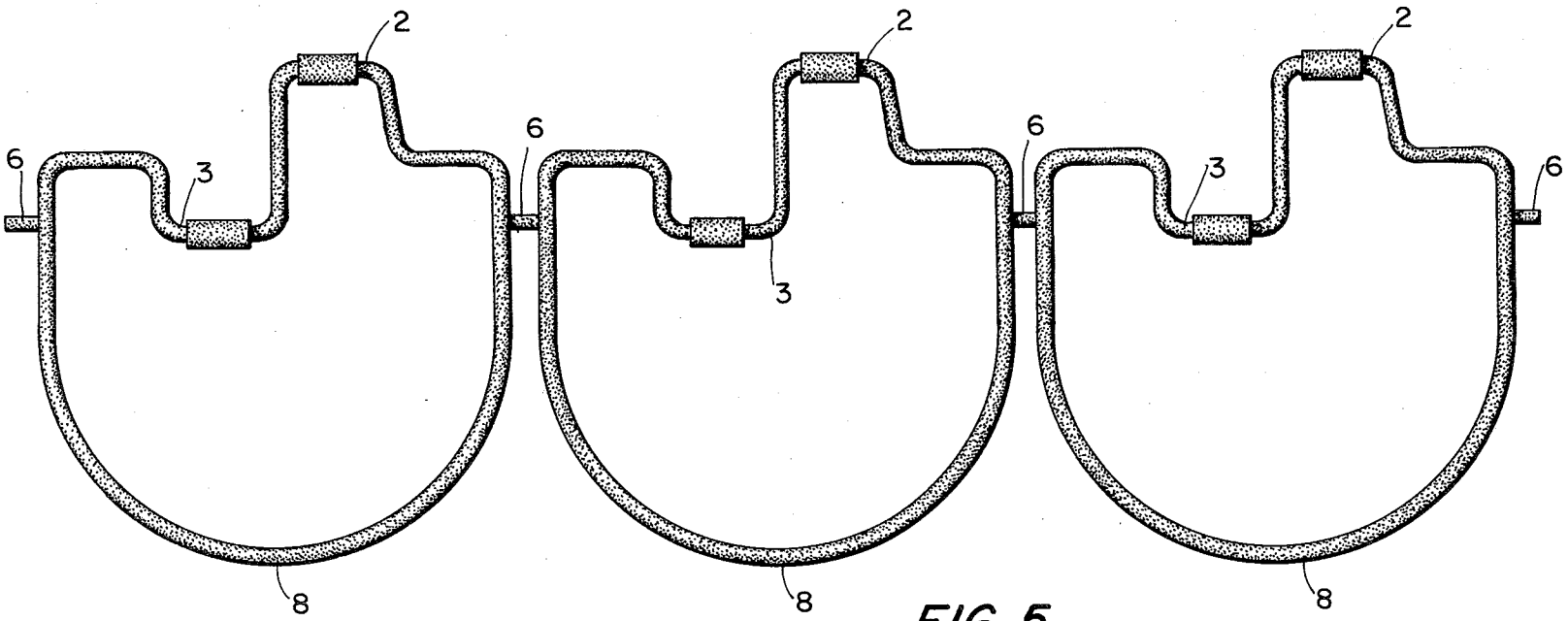
FIG. 5, shows a view of several coupled devices.
Figure 6:
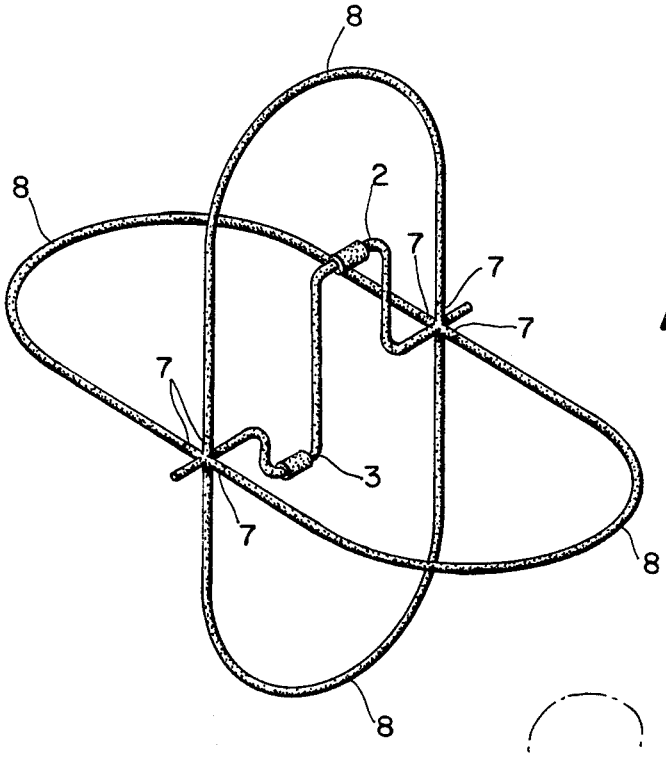
FIG. 6 shows a view of the apparatus to which there have being added several curved sections with the purpose of increasing the number of jumps of the subject.
Figure 7:
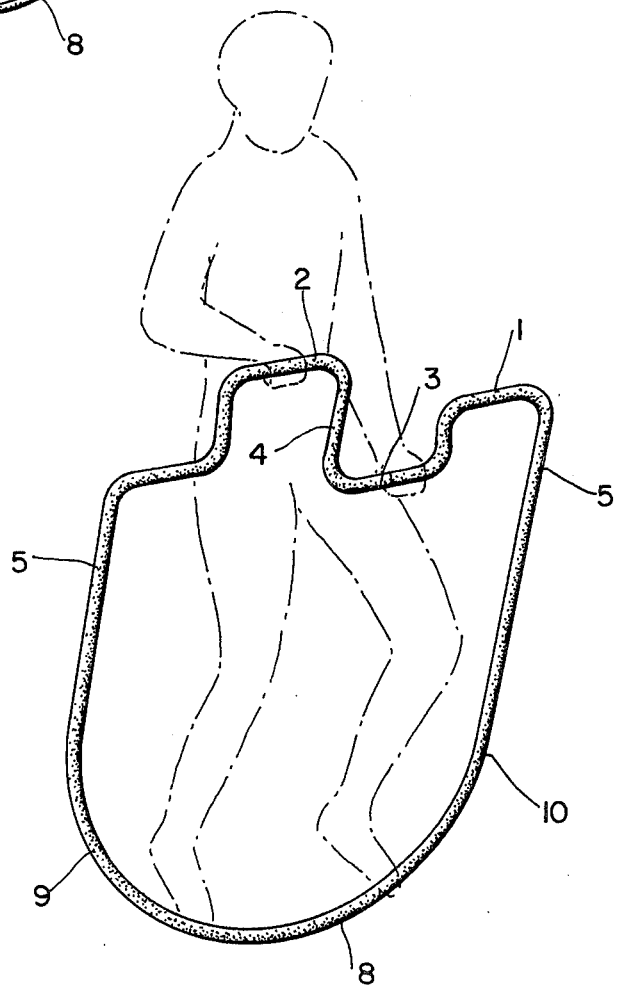
FIG. 7, shows a person utilizing the apparatus.

With reference to said figures, this apparatus is made up by the combination of a handle 1 by means of which, through the human force transmitted by the person who uses it, it is possible to rotate the attached framework above and under the subject, with two offset grips 2 and 3 an upper one 2 and a lower one 3. The grips are joined by means of a central pole 4 which at the same time serves as a point of reference for the subject utilizing the apparatus, by indicating at a simple glance which is the center of the framework. The hand grips 2 and 3 are displaced outwards through an extension which may have a lateral coupling 6 to which a similar apparatus is joined in those cases when it is desired to form a chain of apparata, mainly for the performing of calisthenic excercises of a team. The device may also be provided with one or several further adapters 7 for receiving similar frameworks 8 which would be added to the apparatus and would serve the purpose of forcing the subject who utilizes the apparatus to increase the number of jumps.

The apparatus is provided with a curved framework part 8 having one of its connecting pieces 9 joined at extension 5 to the grip section 2, 3, 4, etc. and similarly the other connecting piece 10 to the other end of the similarly grip section. The framework parts 8, 9, 5 may have various dimensions, depending on the height of the person utilizing the apparatus.

What is claimed is:

1. A rope jumping type device for performing physical exercises comprising in combination, a first jump rope device comprising a single piece carried by only the hands of the user with a hand held handle for rotating the apparatus having two offset grips joined by a central member and having laterally extending connection members to form a cross member horizontally positioned with the user, with a single curved framework part with arms extending from both connecting members in a single plane to produce a substantially U-shaped extension thereto with said offset grips disposed in upper and lower positions generally midway between the curved framework with the connecting members substantially normal to the two framework arms and having a male fitting extending from each of said connecting members a second jump rope device of substantially the same construction as said first device, except the fittings of said second jump rope device for female fittings, said fittings of said first and second jump rope devices being engageable to couple said first and second jump rope devices to permit two or more persons to jump side by side.

2. A rope jumping type device as defined in claim 1 having fitted thereto at least one further U-shaped framework part extending in a plane substantially normal to that of the handle grips.

* * * * *